United States Patent [19]

Dickenson

[11] Patent Number: 4,874,925

[45] Date of Patent: Oct. 17, 1989

[54] ELECTRICALLY HEATED HOSE ASSEMBLY FOR CONVEYING ELECTRICALLY CONDUCTIVE LIQUIDS

[76] Inventor: Wilk A. Dickenson, 2149 Beech St., Abilene, Tex. 79601

[21] Appl. No.: 56,433

[22] Filed: Jun. 1, 1987

[51] Int. Cl.[4] ..... H05B 1/02; H05B 3/58; F24H 1/12

[52] U.S. Cl. ..... 249/301; 137/341; 138/33; 200/61.05; 219/291; 219/308; 219/509

[58] Field of Search ..... 219/296–301, 219/308, 309, 509, 201, 200, 213, 284, 291; 200/61.04, 61.05, 61.06, 190; 137/341; 138/33

[56] References Cited

U.S. PATENT DOCUMENTS

| | | | |
|---|---|---|---|
| 2,243,220 | 5/1941 | Pitman | 219/301 X |
| 3,233,078 | 2/1966 | Siemianowski | 219/509 X |
| 3,378,673 | 4/1968 | Hopper | 219/301 |
| 3,543,803 | 12/1970 | Chrow | 219/301 X |
| 3,619,560 | 11/1971 | Buiting et al. | 219/301 X |
| 4,156,127 | 5/1979 | Sako et al. | 219/301 |
| 4,455,474 | 6/1984 | Jameson et al. | 219/301 |
| 4,553,023 | 11/1985 | Jameson et al. | 219/301 |

*Primary Examiner*—Anthony Bartis

*Attorney, Agent, or Firm*—Kanz, Scherback & Timmons

[57] ABSTRACT

An electrically heated hose for providing heat only to the section of hose which contains an electrically conductive liquid therein includes a plurality of resistance heating elements positioned between inner and outer layers of electrically insulative material defining the hose wall and arranged to sectionalize the hose into individual independently heatable sections. Each heating element has a first terminal connected to a power source and a second terminal connected to at least one of a plurality of spaced electrically conductive members disposed on the inner layer and exposed to any electrically conductive liquid conveyed by the hose. A continuous electrical conductor exposed to any liquid in the hose extends along the entire length thereof in spaced relation to the plurality of conductive members and is connected the power source. The presence of electrically conductive liquid in a separate section of the hose provides electrical continuity between the continuous conductor and at least one of the conductive members in the section to energize at least one heating element associated with the section. The conductive members and conductor are arranged so that the deeper the conductive liquid in a hose section the greater the number of heating elements activated by the liquid.

13 Claims, 5 Drawing Sheets

ELECTRICALLY HEATED HOSE ASSEMBLY FOR CONVEYING ELECTRICALLY CONDUCTIVE LIQUIDS

This invention relates generally to a hose for conveying a liquid medium. More particularly, it relates to an electrically heated hose assembly for conveying a liquid medium in an environment of cold temperatures while maintaining the temperature of the liquid medium above its freezing point.

It is often necessary to expose hoses carrying liquid media to temperatures below freezing. For example, hoses or lines carrying water to a house trailer or recreation vehicle, water hoses at gasoline stations, temporary water hoses at construction sites, water hoses on oil well drilling rigs for washdown, etc., are often exposed to freezing temperatures. To prevent the water from freezing in the hoses, artificial heating of the hose has been used but has often been unsatisfactory for various reasons.

One means of artificial heating is to wrap electrical strip heater tape around the outside surface of the hose or pipe carrying the liquid medium. Some of the electrical strip heater tapes are thermostatically controlled. In an attempt to increase the efficiency of the electrical strip heater tape, a layer of insulating material is sometimes wrapped around the electrical strip heater tape and the hose or pipe. In some hoses, the electrical heating element has been included as an integral part of the hose.

U.S. Pat. No. 2,915,615 discloses an electrical heating unit of the strip type adapted to be wrapped around or otherwise applied to an object to heat same. A control thermostat is operatively connected in the unit and responds to the temperature of the object to be heated.

U.S. Pat. No. 3,378,673 discloses an electrically heated hose assembly including an elongated tubular body in the form of a hose having couplings at opposite ends. The hose has a heater structure spirally wrapped therein for the entire length of the hose. The heater structure is in the form of a double row of high resistance electrical wires covered with heat transmittable electrical insulation and with the wires connectable to a source of electrical power through a thermostat.

The present invention is intended to provide a solution to various prior art deficiencies which include inefficiency in the energy used to heat the hose. Many prior art devices are susceptible to damage when the heating element is applied to the external surface of the hose. When the external heating tape is applied to the outside surface, it may be difficult to maintain the heating tape in position on the hose. If insulation is wrapped around the hose and heating tape, the insulation may be damaged when the hose is moved. Safety may be a factor if the external heating tape is damaged during use of the hose. Much time is consumed in wrapping the hose with the external heating tape and the covering insulation and future repair of same.

The present invention provides an electrically heated hose assembly for providing heat only to the section or sections of the hose which contains a liquid therein. The electrically heated hose assembly includes a hose member having an inner layer of material and an outer layer of material. Heating elements are positioned between the inner and outer layers in predetermined sections of the hose member to sectionalize the hose such that an individual section or sections of the hose member may be heated independently of another section or sections. Means for connecting each individual heating element to a proper power source is included in the hose member and includes an electrically conductive liquid in the hose member. Only that section of the hose member which contains the electrically conductive liquid will be heated by the heating elements located in that section. The deeper the liquid in that section of the hose member, the more heating elements will be activated by the liquid.

Among the advantages offered by the present invention is the capability to provide heat to only that section or sections of the hose member where liquid resides and when the temperature might cause the liquid to freeze. By only heating those sections of the hose member which require heat, electrical energy and costs therefore are saved. Should the heating of the liquid in a section of the hose member decrease the amount of liquid, the amount of heating will decrease. By heating only those sections of the hose member which contains liquids, overheating of the hose member resulting in a possible fire or meltdown of the hose member is greatly reduced. Since the heating elements are totally contained within the hose member, excellent insulation and safety is provided.

Examples of the more important features and advantages of the invention have thus been summarized rather broadly in order that the following detailed description may be better understood and in order that the contribution to the art may be better appreciated. There are, of course, additional features of the invention described hereinafter and which will also form the subject of the claims appended hereto. Other features of the present invention will become apparent with reference to the following detailed description of a presently preferred embodiment thereof in connection with the accompanying drawing in which:

Figure 1:
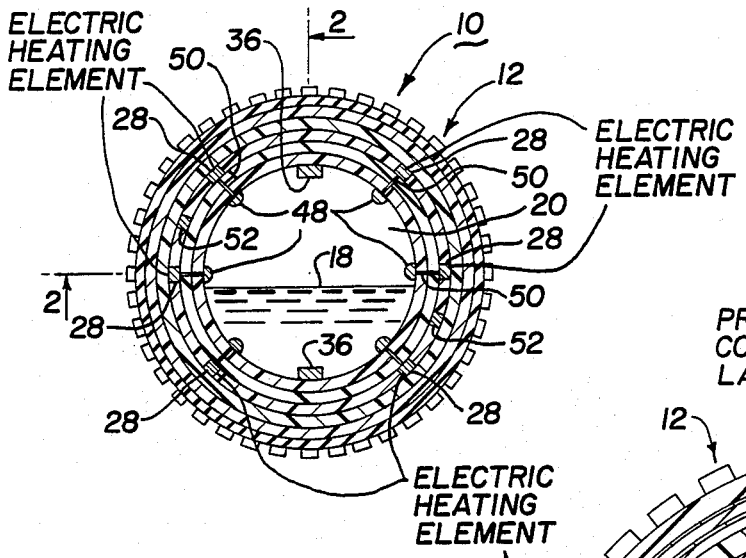
FIG. 1 is a transverse cross-sectional view of a hose incorporating the present invention.
Figure 2:
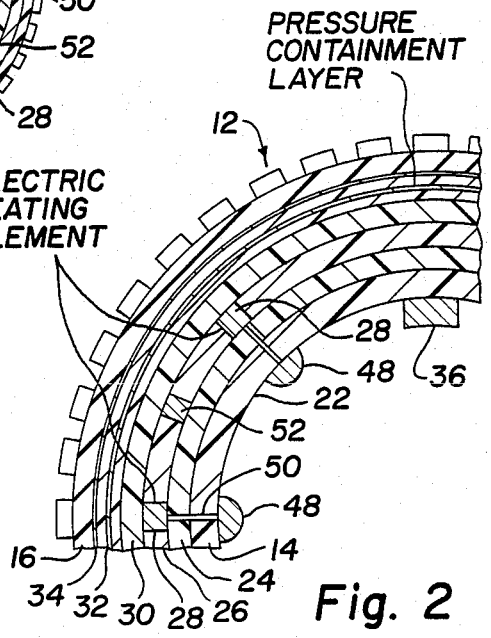
FIG. 2 is an enlarged sectional view taken along lines 2—2 of FIG. 1.
Figure 3:
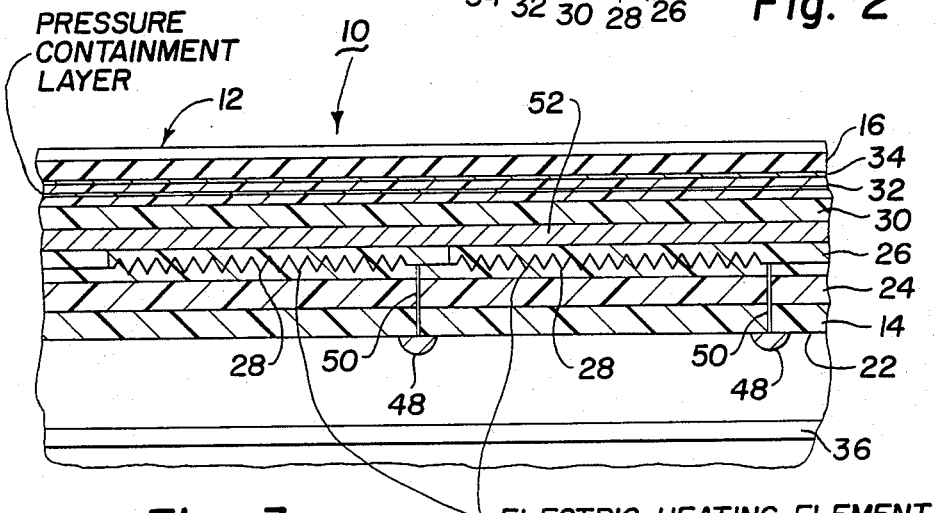
FIG. 3 is a longitudinal cross-sectional view of a portion of a hose incorporating the present invention.
Figure 4:
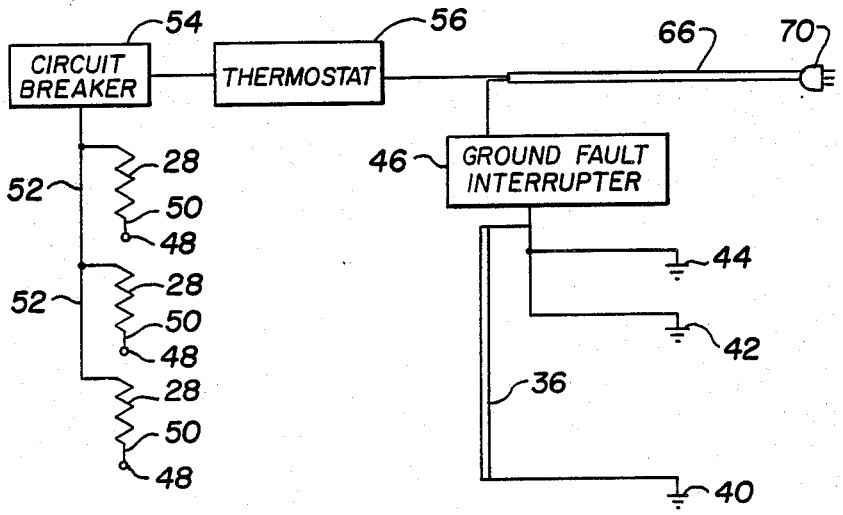
FIG. 4 is a simplified schematic of the electrical system of the present invention.

Referring to the drawing, wherein like reference numerals designate like or corresponding elements throughout the several views, an electrically heated hose assembly is referred to generally by reference numeral 10. With reference to FIGS. 1–3, electrically heated hose assembly 10 comprises a hose member 12 having an inner or first layer of material 14 and an outer layer of material 16. In the preferred embodiment, the inner surface 22 of inner or first layer 14 is treated by conventional methods for protection against abrasion from the liquid medium 18 carried by hose member 12. In the preferred embodiment, the outer layer 16 comprises a layer of plastic, rubber or a rubber compound treated by conventional methods for protection against abrasive wear. A cavity 20 is formed by inner layer 14 for conveying the liquid medium 18 through the hose member 12.

In the preferred embodiment, inner or first layer 14 comprises an electrically non-conductive but heat radiating and/or thermally conductive sealing material for sealing around cavity 20 while allowing heat to pass therethrough to any liquid in cavity 20.

A second layer of material 24 is positioned outwardly from and in a surrounding relationship to inner layer 14 and in the preferred embodiment comprises an electrically non-conductive but heat radiating, embedding and sealing material for sealing and embedding around inner layer 14 while allowing heat to pass therethrough to inner layer of material 14.

A third layer of material 26 is positioned outwardly in a surrounding relationship to second layer 24 and in the preferred embodiment comprises a high heat-conductive polymer material. Embedded within the third layer 26 are a plurality of heating elements 28. In FIG. 1, six separate heating elements 28 are shown in predetermined positions around the hose member 12. It will be appreciated that the heating elements 28 could be configured to be positioned around the hose member 12 in the circumferential direction, the important feature being that a particular group or number of heating elements 28 are positioned in a section of hose member 12 and do not extend the full length of hose member 12. The heating elements 28 and the hose member 12 can be viewed as being sectionalized such that each section of heating elements 28 operates independently to heat only one particular section of the overall hose member. Heating elements 28 may take the form of high resistance electrical wires or other conventional heating means.

A fourth layer of material 30 is positioned outwardly in a surrounding relationship to third layer 26 and in the preferred embodiment comprises a heat radiating and sealing layer.

A fifth layer of material 32 is positioned outwardly in a surrounding relationship to fourth layer 30 and in the preferred embodiment comprises a pressure containment layer including woven or braided nylon or stainless steel which is embedded in a heat reflective plastic to reflect the heat from heating elements 28 toward cavity 20.

A sixth layer of material 34 is positioned outwardly in a surrounding relationship to fifth layer 32 and in the preferred embodiment comprises a heat containment and reflective layer.

The outer layer 16 is positioned outwardly in a surrounding relationship to sixth layer 34.

In the preferred embodiment, heater elements 28 in each particular section are connectable to appropriate power independent of the heater elements 28 in other sections of hose member 12. With reference in FIGS. 1–4, means for connecting the heater elements 28 to a power source includes a first electrically conductive member 36 which extends along substantially the full length of hose member 12. In the preferred embodiment, there are at least two conductive members 36 in opposing positions within the cavity 20. First electrically conductive member 36 is grounded at both ends of hose member 12 and at control box 38 (see FIG. 5) by ground points 40, 42 and 44. First electrically conductive member 36 is connected to the ground or negative side of an appropriate power source through ground fault interrupter 46.

A plurality of second electrically conductive members 48 are located in each sectionalized portion of hose member 12 and are positioned in predetermined locations around hose member 12 in the circumferential direction. Each one of the plurality of second electrically conductive members 48 in a sectionalized portion is operatively connected to a first end of a particular heating element 28 in the sectionalized portion by one of a plurality of first connecting means 50. The second ends of the plurality of heating elements 28 are operatively connected to the hot or positive side of the appropriate power source through second connecting means 52, circuit breaker 54 and thermostat 56. In operation, when the temperature drops below the turn-on temperature set in the thermostat 56, the thermostat 56 connect the second ends of the plurality of heating elements 28 (located along and around hose member 12) to the hot or positive side of the power source. In order to complete the electrical circuit to one or more heating elements 28, an electrical connection must be made between at least one of the first electrically conductive members 36 and a second electrically conductive member 48. This connection only occurs where an electrically conductive liquid medium 18 is located in hose member 12 which contacts both the first electrically conductive member 36 and the second electrically conductive member 48. It will be appreciated that the liquid medium 48 must be capable of conducting electrical current. Heat is not applied to hose member 12 except where the liquid medium 18 in cavity 20 completes the electrical circuit for a heating element 28. The greater the depth of the liquid medium 18 in the cavity, the greater will be the number of heating elements 28 which will be energized and therefore greater heat will be generated for the greater amount of liquid medium 18.

There are now heating elements available in addition to the well known high resistance electrical wire. One such heating element comprises a layer of material exhibiting a positive temperature coefficient of resistance (PTC) and includes a specially blended combination of polymer and conductive carbon (the core) which creates electrical paths between parallel bus wires at every point along the circuit. As the heating element warms, due to the surrounding environment, the core expands microscopically and increases the resistance to electrical flow and causes the heater element to reduce its power output. As the surrounding temperature cools the core, the core contracts microscopically and decreases the resistance to electrical flow and causes the heater element to increase its power output.

Figure 5:
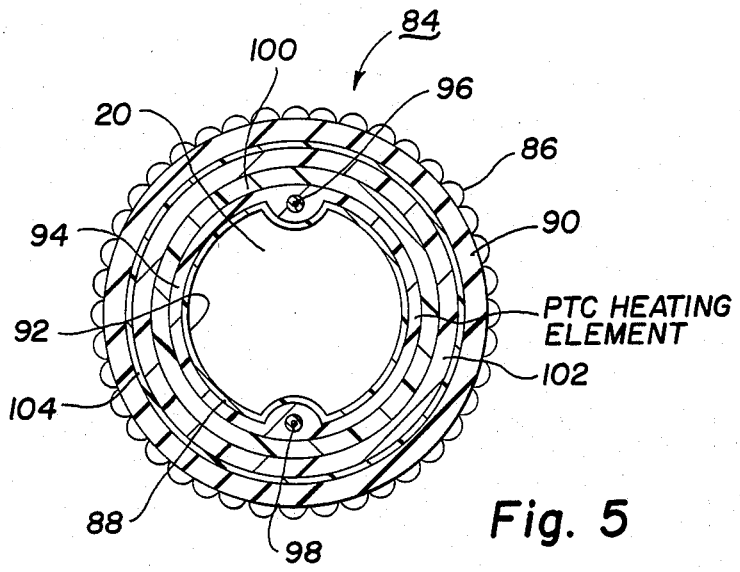
FIG. 5 is a simplified transverse cross-sectional view of a hose incorporating an alternate embodiment of the present invention.

With reference to FIG. 5, an additional embodiment of the present invention is disclosed which uses a layer of material exhibiting a positive temperature coefficient of resistance (PTC). Electrically heated hose assembly 84 comprises a hose member 86 having an inner or first layer of material 88 and an outer layer of material 90. In the preferred embodiment, the inner surface 92 of inner or first layer 88 is treated by conventional methods for protection against abrasion from the liquid medium 18 carried by hose member 86. In the preferred embodiment, the outer layer 90 comprises a layer of plastic, rubber or a rubber compound treated by conventional methods for protection against abrasive wear. A cavity 20 is formed by inner layer 88 for conveying the liquid medium 18 through the hose member 86.

In the preferred embodiment, inner or first layer 88 comprises a heat radiating and sealing material for sealing around cavity 20 while allowing heat to pass therethrough to any liquid in cavity 20.

A second layer of material 94 is positioned outwardly from and in a surrounding relationship to inner or first layer 88 and comprises a material which exhibits a positive temperature coefficient of resistance (PTC). Electrical conductors 96 and 98 are positioned within the PTC material (the core) and are located one hundred and eighty degrees from each other. Electrical conductors 96 and 98 extend along substantially the full length of hose member 86 and are connected to an appropriate power source to energize the PTC material. It will be appreciated that the amount of heat produced by the PTC material will be inversely proportional to the temperature of the air surrounding each particular portion of the hose member 86. It will also be appreciated that the use of the PTC material eliminates the need for a thermostat.

A third layer of material 100 is positioned outwardly in a surrounding relationship to second layer 94 and in the preferred embodiment comprises a heat containment and reflective layer.

A fourth layer of material 102 is positioned outwardly in a surrounding relationship to third layer 100 and in the preferred embodiment comprises a pressure containment layer including woven or braided nylon or stainless steel which is embedded in a heat reflective plastic to reflect the heat, generated by the PTC material of third layer 100, toward cavity 20.

A fifth layer of material 104 is positioned outwardly in a surrounding relationship to fourth layer 102 and in the preferred embodiment comprises a heat containment and reflective layer.

The outer layer 90 is positioned outwardly in a surrounding relationship to fifth layer 32.

Figure 6:
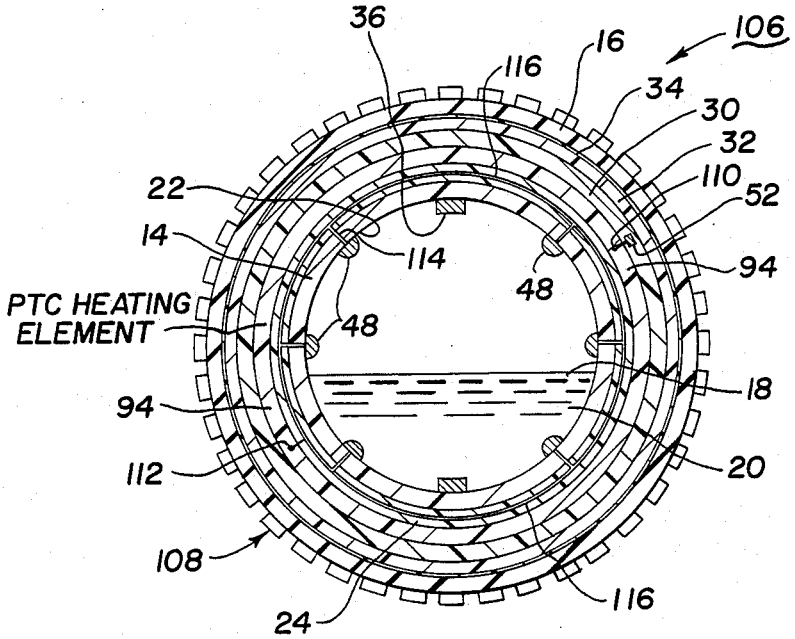
FIG. 6 is a simplified transverse cross-sectional view of a hose incorporating an alternate embodiment of the present invention.

With reference to FIG. 6, an additional embodiment of the present invention is disclosed which uses a layer of PTC material in a hose member which has been configured into individual sections which may be heated separately from one another. Electrically heated hose assembly 106 comprises a hose member 108 having an inner or first layer of material 14 whose inner surface 22 has been treated by conventional methods for protection against abrasion from the liquid medium 18 carried by hose member 108. In the preferred embodiment, the outer layer 16 comprises a layer of plastic, rubber or a rubber compound treated by conventional methods for protection against abrasive wear. A cavity 20 is formed by inner layer 14 for conveying the liquid medium 18 through the hose member 108.

In the preferred embodiment, inner or first layer 14 comprises a heat radiating and sealing material for sealing around cavity 20 while allowing heat to pass therethrough to any liquid in cavity 20.

A second layer of material 24 is positioned outwardly from and in a surrounding relationship to inner layer 14 and in the preferred embodiment comprises a heat radiating, embedding and sealing material for sealing and embedding around inner layer 14 while allowing heat to pass therethrough to inner layer of material 14.

A third layer of material 94 is positioned outwardly from and in a surrounding relationship to second layer 24 and in the preferred embodiment comprises a material which exhibits a positive temperature coefficient of resistance (PTC). Electrical conductors 110 and 112 are positioned within the PTC material and are located approximately one hundred and eighty degrees from each other. Electrical conductors 110 and 112 are sectionalized along the full length of hose member 108 such that the electrical conductors 110 and 112 are continuous conductors in each particular section but are discontinuous between sections of hose member 108. It will be appreciated that the amount of heat produced by the PTC material in each particular section will be inversely proportional to the temperature of the air surrounding each particular portion of the hose member 108. It will also be appreciated that the PTC material in a particular section will not produce any heat until power is applied to electrical conductors 110 and 112 in that particular section.

A fourth layer of material 30 is positioned outwardly in a surrounding relationship to third layer 94 and in the preferred embodiment comprises a heat radiating and sealing layer.

A fifth layer of material 32 is positioned outwardly in a surrounding relationship to fourth layer 30 and in the preferred embodiment comprises a pressure containment layer including woven or braided nylon or stainless steel which is embedded in a heat reflective plastic to reflect the heat from heating elements 28 toward cavity 20.

A sixth layer of material 34 is positioned outwardly in a surrounding relationship to fifth layer 32 and in the preferred embodiment comprises a heat containment and reflective layer.

Figure 7:
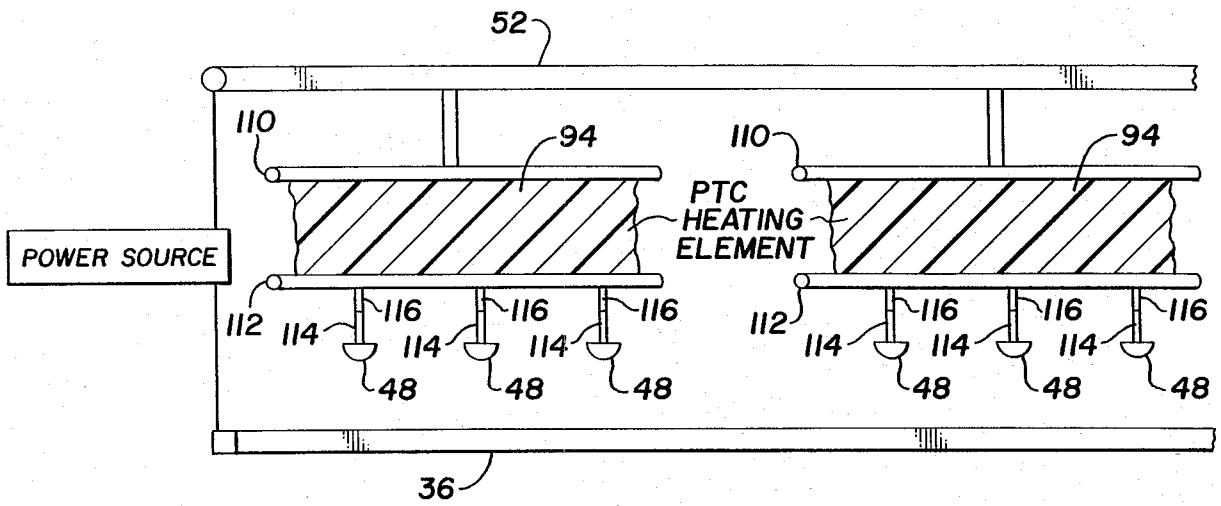
FIG. 7 is a simplified schematic of the electrical system of the alternate embodiment of the present invention.

In the preferred embodiment, electrical conductors 110 and 112 in each particular section are connectable to appropriate power independent of the electrical conductors 110 and 112 in other sections of hose member 108. With reference to FIG. 7, means for connecting the electrical conductors 110 and 112 to a power source includes a first electrically conductive member 36 which extends along substantially the full length of hose member 108. In the preferred embodiment, there are at least two conductive members 36 in opposing positions within the cavity 20. First electrically conductive member 36 is grounded at both ends of hose member 108 and at control box 38 (see FIG. 5). First electrically conductive member 36 is connected to the ground or negative side of an appropriate power source through ground fault interrupter 46.

A plurality of second electrically conductive members 48 are located in each sectionalized portion of hose member 108 and are positioned in predetermined locations around hose member 108 in the circumferential direction. Each one of the plurality of second electrically conductive members 48 in a sectionalized portion is operatively connected by electrical connector means 114 to an electrical conductor 116 embedded in the second layer of material 24. An electrical conductor 116 is positioned in each sectionalized portion of hose member 108. Electrical conductor 116 is operatively connected to electrical conductor 112 located in third layer of material 94. Electrical conductor 110 is operatively connected to the hot or positive side of the appropriate power source through second connecting means 52 which is located in the fourth layer of material 30.

With reference to the simplified schematic of FIG. 7, first electrically conductive member 36 extends along substantially the full length of hose member 108 and is not sectionalized. Second connecting means 52 also extends along substantially the full length of hose member 108 and is not sectionalized. Individual and isolated sections of electrical conductors 110 and 112 are located in each predetermined section of hose member 108 with the core of PTC material 94 located between the electrical conductors 110 and 112. Each of the second electrically conductive members 48 are operatively connected to electrical conductor 112 by electrical connector means 114 and electrical conductor 116. The water or other electrically conductive liquid in hose member 108 completes the electrical circuit by providing continuity between first electrically conductive member 36 and one or more of the second electrically conductive members 48.

Figure 8:
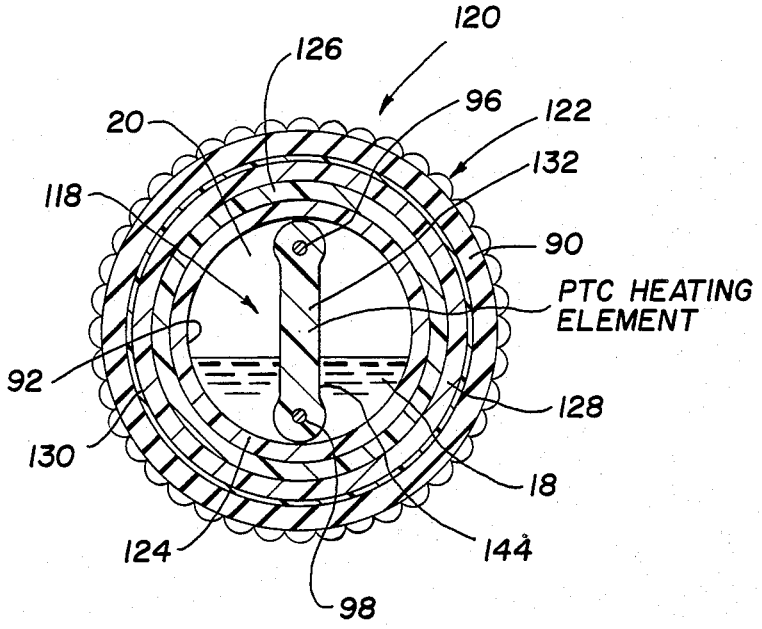
FIG. 8 is a simplified transverse cross-sectional view of a hose member and an alternate embodiment of the present invention.

With the reference to FIG. 8, an additional embodiment of the present invention is disclosed which comprises a removably insertable heating assembly 118 for insertion within the cavity 20 of hose member 122 which is a portion of hose assembly 120. Hose assembly 120 comprises a hose member 122 having an inner or first layer of material 124 and an outer layer of material 90. In the preferred embodiment, the inner surface 92 of inner or first layer 124 is treated by conventional methods for protection against abrasion from the liquid medium 18 carried by hose member 122. In the preferred embodiment, the outer layer 90 comprises a layer of plastic, rubber or a rubber compound treated by conventional methods for protection against abrasive wear. A cavity 20 is formed by inner layer 124 for conveying the liquid medium 18 through the hose member 122.

In the preferred embodiment, inner or first layer 124 comprises a heat containment and reflective material for sealing around cavity 20 while reducing the amount of heat allowed to pass therethrough from cavity 20.

A second layer of material 126 is positioned outwardly in a surrounding relationship to inner or first layer 124 and in the preferred embodiment comprises a heat containment and reflective layer.

The third layer of material 128 is positioned outwardly in a surrounding relationship to second layer 126 and in the preferred embodiment comprises a pressure containment layer including woven or braided nylon or stainless steel which is embedded in a heat reflective plastic to reflect any heat escaping from cavity 20.

A fourth layer of material 130 is positioned outwardly in a surrounding relationship to third layer 128 and in the preferred embodiment comprises a heat containment and reflective layer.

The outer layer 90 is positioned outwardly in a surrounding relationship to fourth layer 130.

Removably inserted within cavity 20 is heating assembly 118 which comprises heating element 132 which in the preferred embodiment is formed of a material which exhibits a positive temperature coefficient of resistance (PTC). It will be appreciated that heating element 132 could be formed of high resistance electrical wire. Heating element 132 extends along cavity 20 for substantially the full length of hose member 122. Electrical conductors 96 and 98 are positioned within the heating element 132 (the PTC material) and are located near the two extremities of the heating element 132 and are approximately one hundred and eighty degrees from each other. Electrical conductors 96 and 98 extend along substantially the full length of heating element 132 and are connected to an appropriate power source to energize the PTC material of heating element 132.

It will be appreciated that the physical size of heating element 132 will be such that it may be inserted into the cavity 20 of the particular hose member where it is desired to be used to heat any liquid medium 18 residing therein. It will also be appreciated that the hose member 122 need not be an integral part of control box 38 (as shown in FIG. 5) since the heating assembly 118 is a separate insertable assembly and control box 38 could be modified to include a male hose bib connector where the hose overlay 80 now resides. The female hose bib connector on any appropriate hose assembly could be attached to the male hose bib connector on control box 38. It will also be appreciated that the heating assembly 118 will extend outwardly from control box 38 through the male hose bib connector and be inserted into the cavity of the hose member which would be connected to control box 38. Electrical connectors 96 and 98 would be operatively connected to the appropriate power source through control box 38. The heating assembly 118 and operatively connected control box 38 could be used with many different hose members, one at a time.

Figure 9:
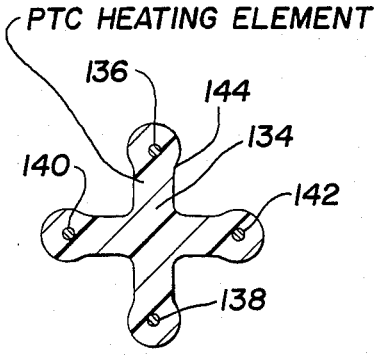
FIG. 9 is a simplified transverse cross-sectional view of an alternate embodiment of the present invention.

With reference to FIG. 9, an additional embodiment of the heating element is disclosed which provides a larger heating element for a given size of cavity in a hose member. Heating element 134 is formed in a shape such that the cross-section thereof is generally in the shape of a cross. Heating element 134 includes four finger-like extensions which are spaced approximately ninety degrees apart. Appropriate electrical insulative material 144 covers the entire external surface of heating element 134. Electrical conductors 136, 138 140 and 142 are positioned within the heating element 134 with one predetermined conductor located in each of the four finger-like extensions. Electrical conductors 136, 138, 140 and 142 extend along substantially the full length of heating element 134 and are operatively connected to an appropriate power source. It will be appreciated that electrical conductors 136 and 140 could be connected to the positive terminal of the power source and electrical conductors 138 and 142 could be connected to the negative terminal of the power source. It will be appreciated that the physical size of the heating element 134 will be such that it may be inserted into the cavity 20 of the particular hose with which it is to be used.

Figure 10:
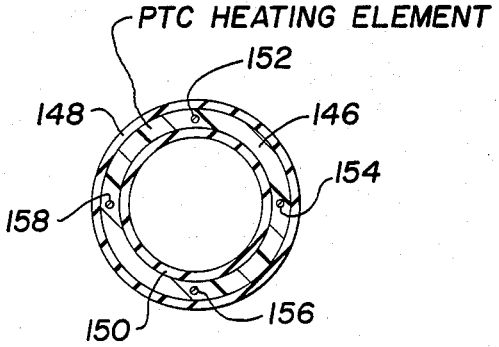
FIG. 10 is a simplified transverse cross-sectional view of an alternate embodiment of the present invention.

With reference to FIG. 10, an additional embodiment of the heating element is disclosed which provides a different shape thereto. Heating element 146 is formed into a tubular configuration such that the cross-section thereof is generally in the shape of a circle. A first layer of electrical insulative material 148 is formed on the outside surface of heating element 146 and a second layer of electrical insulative material 150 is formed on the inside surface of heating element 146. The diameter of the outside surface (including the first layer of electrical insulative material 148) is of a value which will allow the heating element 146 to be inserted into the cavity of the particular size hose with which the heating element 146 is to be used. Positioned at ninety degree intervals around heating element 146 are electrical conductors 152, 154, 156 and 158 which are positioned within the heating element 146. Electrical conductors 152, 154, 156 and 158 extend along substantially the full length of heating element 146 and are operatively connected to an appropriate power source. It will be appreciated that electrical conductors 152 and 158 could be connected to the positive terminal of the power source and electrical conductors 154 and 156 could be connected to the negative terminal of the power source.

The principal use of the present invention is to carry or transport electrically conductive liquids where the hose assembly is exposed to freezing temperatures. It will be appreciated that the hose assembly may be used to transport sewage from recreational vehicles, ships tied to a pier or dock, etc. The inventive hose assembly may be constructed in sizes from the typical ¾ inch hose to hoses eight, ten, twelve inches in diameter and larger. In the larger diameter hoses, more heating elements and more sectionalized systems could be added to the hose to accommodate the greater fluid that needed to be heated to avoid the freezing thereof. The inventive hose assembly may be constructed in any reasonable length, with any reasonable number of sections making up the hose assembly, with sections of various lengths, with various numbers of heating elements in each section of hose, with various wattage ratings for the heating elements and with various spacings between the heating elements; most of the previous factors being determined by the operating environment and conditions as well as the volume of liquid which might be in the hose.

Although the present invention has been described herein with reference to specific forms thereof, it is evident that many alternatives, modifications and variations will become apparent to those skilled in the art in light of the foregoing disclosure. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements may be substituted for those illustrated and described herein, parts may be reversed, and certain features of the invention may be utilized independently of other features of the invention. It will be appreciated that various modifications, alternatives, variations, etc., may be made without departing from the spirit and scope of the invention in the appended claims.

What is claimed:

1. A hose assembly comprising:

a hose member for conveying an electrically conductive liquid therethrough, said member including an outer layer of material and an inner layer of electrically insulative material, said inner layer of electrically insulative material forming a cavity for conveying said electrically conductive liquid;

a first electrically conductive member positioned within said cavity so as to be exposed to any electrically conductive liquid conveyed by said hose member and extending as a continuous member along substantially the entire length of said hose member;

means for operatively connecting said first electrically conductive member to a first terminal of a power source;

a plurality of heating elements having a first terminal and a second terminal with at least one of said plurality of heating elements being positioned in a separate section of predetermined length of said hose member along the length of said hose member to independently provide heat to each separate section, said plurality of heating elements being positioned between said outer and inner layers of material of said hose member;

means for operatively connecting said first terminal of each of said plurality of heating elements to a second terminal of the power source;

a plurality of second electrically conductive members with at least one of said plurality of second electrically conductive members being positioned within the cavity in each separate section of hose member of predetermined length and positioned so as to be exposed to any electrically conductive liquid conveyed by said hose member; and means for operatively connecting each of the at least one of said plurality of second electrically conductive members positioned in each separate section of hose member to said second terminal of each of the at least one of said plurality of heating elements positioned in each separate section of hose member, whereby the presence of an electrically conductive liquid in a separate section of the hose member provides electrical continuity between the at least one second electrically conductive member in said section and said continuous first electrically conductive member to complete the electrical circuit to the at least one heating element in said separate section to cause heating of said separate section of said hose member.

2. The hose assembly of claim 1 wherein said inner layer of material comprises a heat radiating and sealing material.

3. The hose assembly of claim 2 further including a second layer of material positioned between said inner layer and said heating elements, said second layer of material comprising a heat radiating and embedding material.

4. The hose assembly of claim 3 wherein said heating elements are embedded in a third layer of material, said third layer of material comprising a high heat-conductive polymer material.

5. The hose assembly of claim 4 further including a fourth layer of material positioned between said third layer of material and said outer layer of material, said fourth layer of material comprising a heat radiating and embedding material.

6. The hose assembly of claim 5 further including a fifth layer of material positioned between said fourth layer of material and said outer layer of material, said fifth layer of material comprising a pressure containment layer embedded in heat reflective plastic.

7. The hose assembly of claim 6 further including a sixth layer of material positioned between said fifth layer of material and said outer layer of material, said sixth layer of material comprising a heat containment-reflective layer.

8. The hose assembly of claim 7 wherein said inner layer of material comprises a material treated for protection against abrasive wear from said liquid.

9. The hose assembly of claim 7 wherein said outer layer of material comprises a layer of a rubber compound treated for protection against abrasive wear.

10. The hose assembly of claim 1 further including a circuit breaker operatively connected between said means for operatively connecting said first terminal of each of said plurality of heating elements and said predetermined power source.

11. The hose assembly of claim 10 further including a thermostat assembly operatively connected between said circuit breaker and said power source.

12. The hose assembly of claim 1 wherein said plurality of heating elements comprises high resistance electrical wires.

13. The hose assembly of claim 1 wherein said plurality of heating elements comprises material exhibiting a positive temperature coefficient of resistance.

* * * * *